US010159351B1

(12) United States Patent
Alexander et al.

(10) Patent No.: US 10,159,351 B1
(45) Date of Patent: Dec. 25, 2018

(54) VARIABLE STIFFNESS TEXTILE PANEL ASSEMBLY

(71) Applicant: GM GLOBAL TECHNOLOGY OPERATIONS LLC, Detroit, MI (US)

(72) Inventors: Paul W. Alexander, Ypsilanti, MI (US); Nancy L. Johnson, Northville, MI (US); Nilesh D. Mankame, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/854,202

(22) Filed: Dec. 26, 2017

(51) Int. Cl.
*A47C 7/28* (2006.01)
*A47C 31/12* (2006.01)
*A47C 7/32* (2006.01)

(52) U.S. Cl.
CPC ..... *A47C 7/282* (2013.01); *A47C 7/32* (2013.01); *A47C 31/126* (2013.01)

(58) Field of Classification Search
CPC ..... A47C 7/282; A47C 7/32; A47C 31/126
USPC ..... 297/284.2, 452.64, 452.63, 452.56, 207, 297/205, 204
See application file for complete search history.

(56) References Cited

U.S. PATENT DOCUMENTS 3,273,877 A * 9/1966 Geller ..... B60N 2/72 267/89
5,316,371 A * 5/1994 Bishai ..... B60N 2/7094 297/284.1
5,860,700 A * 1/1999 Lance ..... A47C 7/462 297/284.2
6,311,570 B1 * 11/2001 Niedermuhlbichler ..... A47C 23/28 297/284.2
2003/0001424 A1 * 1/2003 Mundell ..... A47C 7/16 297/452.56

* cited by examiner

*Primary Examiner* — Milton Nelson, Jr.
(74) *Attorney, Agent, or Firm* — Quinn IP Law

(57) ABSTRACT

A panel assembly includes a frame and a textile panel. The frame has a first member and a second member spaced apart from each other. The textile panel is attached to and extends between the first member and the second member. A tension controlling system is attached to the textile panel. The tension controlling system is reconfigurable between a first state for tensioning the textile panel to provide a first tensile force and a first maximum sag distance, and a second state for tensioning the textile panel to provide a second tensile force and a second maximum sag distance. The first tensile force is greater than the second tensile force, and the first maximum sag distance is less than the second maximum sag distance.

11 Claims, 2 Drawing Sheets

VARIABLE STIFFNESS TEXTILE PANEL ASSEMBLY

INTRODUCTION

The disclosure generally relates to a panel assembly for a seat bottom.

A seat bottom of a seat carries a vertical load from an occupant. The seat bottom may include a support system that supports a cushion. The support system and the cushion may be covered with an exterior covering, such as a cloth, leather, vinyl, etc. The support system may include a frame and a load carrying member, such as a set of springs attached to the frame or a fabric stretched tightly across the frame. The load carrying member transfers the vertical load applied to the seat bottom to the frame, and may also be used dampen vibration.

SUMMARY

A panel assembly for a seat bottom is disclosed. The panel assembly includes a frame and a textile panel. The frame has a first member and a second member spaced apart from each other. The textile panel is attached to and extends between the first member and the second member of the frame. A tension controlling system is attached to the textile panel. The tension controlling system is reconfigurable between a first state and a second state. When the tension controlling system is disposed in the first state, the tension controlling system is operable to tension the textile panel to provide a first tensile force. When the tension controlling system is disposed in the second state, the tension controlling system is operable to tension the textile panel to provide a second tensile force, with the first tensile force being different from the second tensile force.

In one aspect of the disclosure, the textile panel includes at least one of a woven structure or a knitted structure.

In one aspect of the disclosure, the textile panel exhibits a first maximum sag distance relative to a reference plane when the tension controlling system is disposed in the first state, and the textile panel exhibits a second maximum sag distance relative to the reference plane when the tension controlling system is disposed in the second state. The second maximum sag distance is greater than the first maximum sag distance.

In another aspect of the disclosure, the textile panel includes a first edge and an opposing second edge. The first edge and the second edge extend along a central panel axis. The textile panel is attached to the first member along the first edge, and is attached to the second member along the second edge. The textile panel further includes a third edge and a fourth edge spaced apart from each other and extending between the first member and the second member respectively. As such, each of the third edge and the fourth edge extend between the first edge and the second edge of the textile panel.

In one embodiment of the disclosure, the tension controlling system includes at least one frangible link in the textile panel. In one exemplary embodiment, the tension controlling system includes a plurality of frangible links. Each of the frangible links interconnect and draw together a first location and a second location of the textile panel, in order to gather the textile panel and form a loop in the textile panel. The loop extends along a loop centerline that is generally parallel with the first edge and the second edge of the textile panel. The first state of the tension controlling system is a non-fractured state of the frangible link, and the second state of the tension controlling system is a fractured state of the frangible link. The frangible link fractures to change between the first state and the second state in response to a pre-defined force being applied to the textile panel.

In another embodiment of the disclosure, the tension controlling system includes a tension filament attached to the textile panel. The tension filament interconnects the first member and the second member of the frame. The tension filament includes a first portion extending generally parallel with the first edge and the second edge. In one exemplary embodiment, the first portion of the tension filament extends between the third edge and the fourth edge of the textile panel. The tension filament may further include a second portion extending generally parallel with the first portion of the tension filament. In one exemplary embodiment, the second portion of the tension filament extends between the third edge and the fourth edge of the textile panel.

In aspect of the disclosure, the tension filament has a first length measured along a centerline of the tension filament, between the first member and the second member, when the tension controlling system is disposed in the first state. The tension filament has a second length measured along the centerline of the tension filament, between the first member and the second member, when the tension controlling system is disposed in the second state, with the second length greater than the first length.

In one embodiment of the disclosure, the tension filament is an active material that is operable to change shapes between a first shape and a second shape. The tension filament exhibits a first length along a centerline of the tension filament when disposed in the first shape. The tension filament exhibits a second length along the centerline of the tension filament when disposed in the second shape. The first state of the tension controlling system is the first shape of the tension filament, and the second state of the tension controlling system is the second shape of the tension filament.

In another embodiment of the disclosure, the tension controlling system includes an actuator attached to the tension filament. The actuator is operable to change a length of the tension filament along a centerline of the tension filament. In one exemplary embodiment, the actuator is operable to retract in or release out the tension filament. In another exemplary embodiment of the disclosure, the actuator is operable to apply an electrical signal to the tension filament to cause a phase change in the tension filament. The resultant phase change in the tension filament results in a change in the length of the tension filament.

In one aspect of the disclosure, the actuator is operable to repeatedly move the tension filament between a first length and a second length, in a sequential order, in order to communicate a haptic message.

Accordingly, changing the state of the tension controlling system between the first state and the second state changes the maximum sag distance of the textile panel relative to the reference plane. By increasing the sag distance, the tension controlling system may provide a deeper seat pocket for an occupant, which helps to restrain the occupant from forward motion in response to a sudden stop. The movement of the tension controlling system may be sequentially repeated in a cyclical manner to communicate a haptic message to a seat occupant.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of a number of hardware, software, and/or firmware components configured to perform the specified functions.

Figure 1:
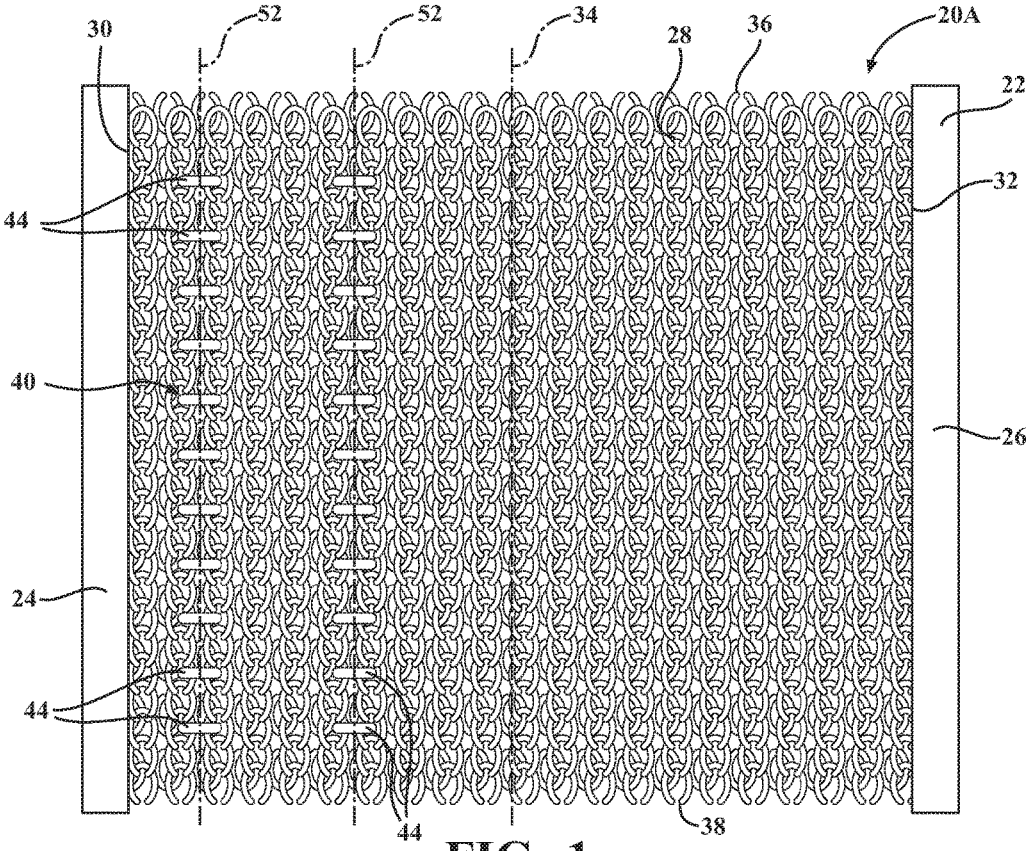
FIG. 1 is a schematic plan view of a first embodiment of a panel assembly.
Figure 2:
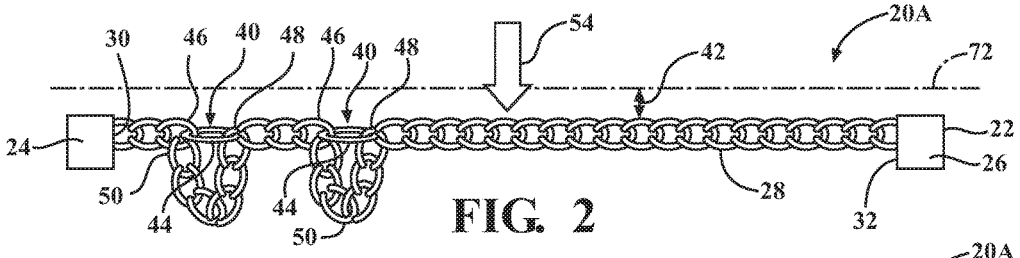
FIG. 2 is a schematic cross sectional view of the first embodiment of the panel assembly showing a plurality of frangible links in a non-fractured first state.
Figure 3:
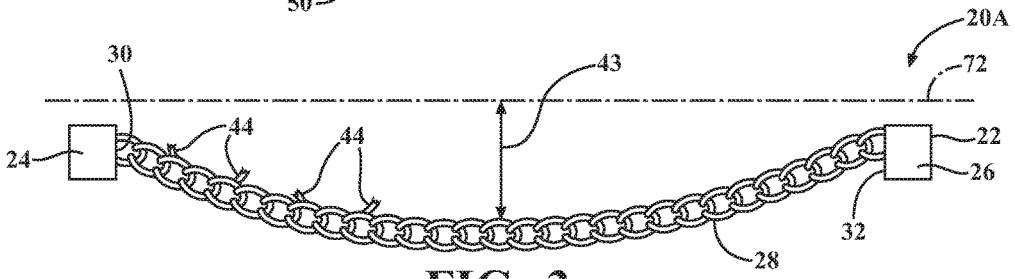
FIG. 3 is a schematic cross sectional view of the first embodiment of the panel assembly showing the plurality of frangible links in a fractured second state.
Figure 4:
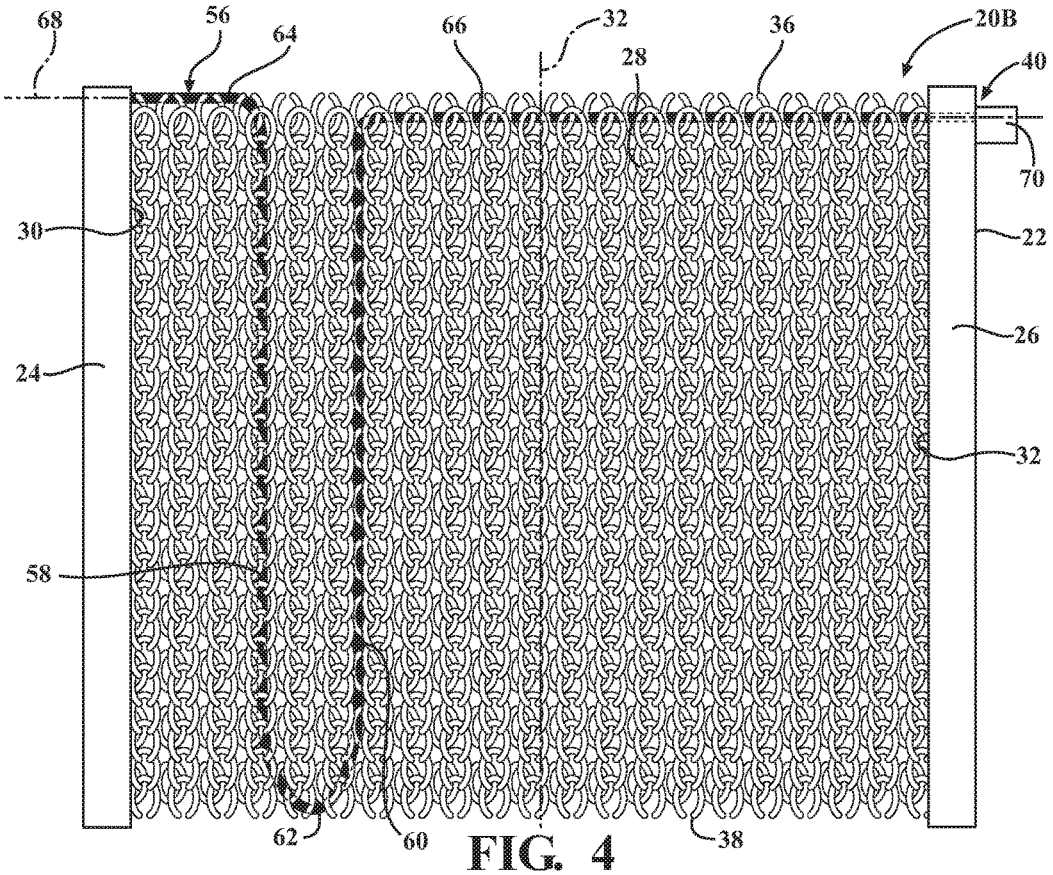
FIG. 4 is a schematic plan view of a second embodiment of the panel assembly.
Figure 5:
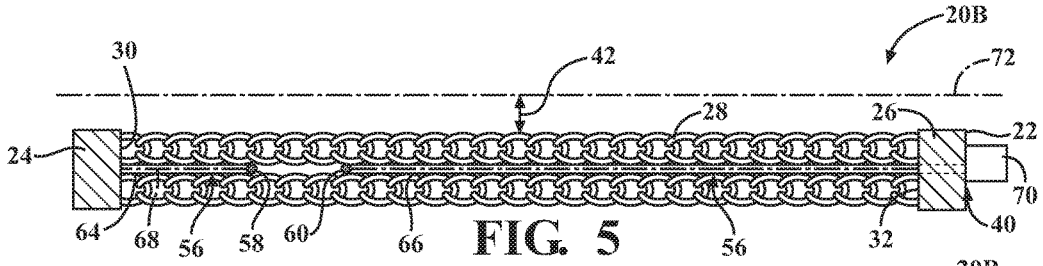
FIG. 5 is a schematic cross sectional view of the second embodiment of the panel assembly showing a tension filament in a first state.
Figure 6:
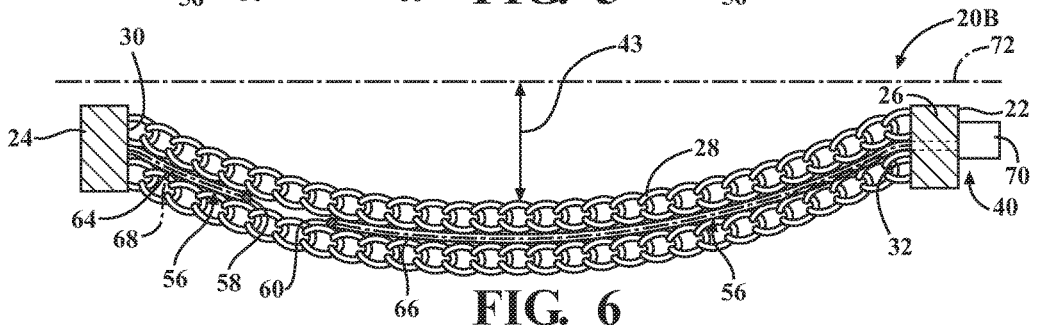
FIG. 6 is a schematic cross sectional view of the second embodiment of the panel assembly showing the tension filament in a second state.

Referring to the FIGS., wherein like numerals indicate like parts throughout the several views, a first embodiment of a panel assembly is generally shown at 20A in FIGS. 1-3, and a second embodiment of the panel assembly is generally shown at 20B in FIGS. 4-6. The panel assembly 20A, 20B may be used as a seat bottom to support a load 54 from an occupant in a seat. Particularly, the panel assembly 20A, 20B may be incorporated into a seat of a vehicle. However, it should be appreciated that the panel assembly 20A, 20B may be incorporated into some other article and used for some other purpose than described herein. Accordingly, the panel assembly 20A, 20B should not be limited to the exemplary embodiment of a seat bottom described herein.

The panel assembly 20A, 20B includes a frame 22. The frame 22 includes at least a first member 24 and a second member 26. The first member 24 and the second member 26 are spaced apart from each other in a generally parallel relationship. The first member 24 and the second member 26 may be attached to each other with other components or members (not shown). The frame 22 may be constructed in a suitable manner, from materials suitable for the intended purpose of the panel assembly 20A, 20B. The particular shape, size, material, etc. of the frame 22 are not pertinent to the teachings of this disclosure, and are therefore not described in detail herein.

A textile panel 28 is attached to and extends between the first member 24 and the second member 26. The textile panel 28 includes at least one of a woven structure or a knitted structure. The textile panel 28 may include a material which is formed by one or more of weaving, knitting, crocheting, braiding or a combination of these to form the textile material, and where weaving generates a woven structure in the textile material, knitting generates a knitted structure in the textile material, crocheting generates a crocheted structure in the material, and braiding generates a braided structure in the textile material. It would be appreciated that the textile material made using a combination of these methods could have portions of the textile material which incorporate multiple structures, for example, a knitted portion could be formed using braided fibers, fibers could be woven through a knitted or crocheted structure to provide dimensional strength and/or stabilization, a crocheted edge could be formed on a knitted or woven structure, woven layers could be knitted together to form a multi-layer textile material such as a 3D textile material, etc. The textile panel 28 may be manufactured from natural fibers or synthetic fibers. The textile panel 28 may include a stitch pattern, a needle size, a yarn type, a yarn denier, a fiber type, a fiber size, a stitch density, a warp pattern, a weft pattern, and/or a weave type suitable for the intended purpose and required operating characteristics of the panel assembly 20A, 20B.

The textile panel 28 includes a first edge 30 and an opposing second edge 32. The first edge 30 and the second edge 32 extend along a central panel axis 34. In the exemplary embodiment shown, the first edge 30 and the second edge 32 are generally parallel with each other. However, it should be appreciated that the first edge 30 and the second edge 32 may be oriented in a non-parallel orientation. The first edge 30 of the textile panel 28 is attached to the first member 24, and the second edge 32 of the textile panel 28 is attached to the second member 26. The first edge 30 and the second edge 32 of the textile panel 28 may be attached to the first member 24 and the second member 26 respectively in a suitable manner. For example, the first edge 30 and the second edge 32 may be attached to the first member 24 and the second member 26 respectively using mechanical fasteners, clamping members, hooks, an adhesive, or in some other manner not described herein.

The textile panel 28 includes a third edge 36 and a fourth edge 38. The third edge 36 and the fourth edge 38 are spaced apart from each other, and each extend between the first member 24 and the second member 26. Accordingly, the first edge 30, the third edge 36, the second edge 32, and the fourth edge 38 cooperate to form a perimeter or exterior edge of the textile panel 28 shown in the figures. The third edge 36 and the fourth edge 38 are generally transverse to the central panel axis 34, and are also generally transverse to the first edge 30 and the second edge 32.

The panel assembly 20A, 20B includes a tension controlling system 40. The tension controlling system 40 is attached to the textile panel 28, and is reconfigurable between a first state and a second state. When the tension controlling system 40 is disposed in the first state, the tension controlling system 40 is operable to tension the textile panel 28 to provide a first tensile force. When the tension controlling system 40 is disposed in the second state, the tension controlling system 40 is operable to tension the textile panel 28 to provide a second tensile force. The first tensile force is different from the second tensile force. In the exemplary embodiment described herein, the first tensile force is greater than the second tensile force.

When the tension controlling system 40 is disposed in the first state, the textile panel 28 exhibits a first maximum sag distance 42 (shown in FIGS. 2 and 5) relative to a reference plane 72. The reference plane 72 may be defined as a plane positioned generally parallel to the frame 22 such that the textile panel 28 sags away from the reference plane 72. As such, if the textile panel 28 is positioned in a generally horizontal orientation, gravity causes the textile panel 28 to sag downward. Therefore, the reference plane 72 may be defined as a plane positioned vertically above and generally parallel with the first member 24 and the second member 26. The maximum sag distance is the maximum or largest distance between the textile panel 28 and the reference plane 72. Accordingly, the first maximum sag distance 42 is the maximum sag distance when the tension controlling system 40 is disposed in the first state. When the tension controlling system 40 is disposed in the second state, the textile panel 28 exhibits a second maximum sag distance 43 (shown in FIGS. 3 and 6) relative to the reference plane 72. The second maximum sag distance 43 is the maximum sag distance when the tension controlling system 40 is disposed in the second state. The first maximum sag distance 42 is different from the second maximum sag distance 43. In the exemplary embodiment described herein, the second maximum sag distance 43 greater than the first maximum sag distance 42.

Referring to FIGS. 1 through 3, the tension controlling system 40 of the first embodiment of the panel assembly 20A includes a frangible link 44 in the textile panel 28. In the exemplary embodiment shown in the figures and described herein, the tension controlling system 40 includes a plurality of frangible links 44 in the textile panel 28. Referring to FIG. 2, each of the frangible links 44 interconnect and draw together a respective first location 46 and a respective second location 48 of the textile panel 28, to gather the textile panel 28 together and form a loop 50 in the textile panel 28. As shown in FIG. 1, a group of the frangible links 44 are arranged in a row that extends along a loop centerline 52. The textile panel 28 may include multiple groups of frangible links 44, with each group arranged along a respective loop centerline 52. The frangible links 44 of each respective group gather the textile panel 28 to form a respective loop 50. The loop 50 formed by each respective group of frangible links 44 extends along the loop centerline 52 of that respective group. The loop centerlines 52 of the loops 50 are generally parallel with the first edge 30 and the second edge 32 of the textile panel 28.

The frangible links 44 are made from a material that has a lower tensile strength than the material forming the textile panel 28. In other words, the frangible links 44 are weaker than the textile panel 28. The specific strength of the frangible links 44 and the textile panel 28 may vary, depending upon the specific application of the panel assembly 20A. Referring to FIG. 3, in response to a load 54 applied to the textile panel 28, the frangible links 44 fracture or break, thereby releasing the loops 50 and allowing the textile panel 28 to sag further away from the reference plane 72, i.e., increasing the maximum sag distance 43. In the exemplary embodiment shown and described herein, the first state of the tension controlling system 40 may be defined as a non-fractured state of the frangible links 44, shown in FIG. 2, and the second state of the tension controlling system 40 may be defined as a fractured state of the frangible link 44, shown in FIG. 3. In response to a pre-defined force or load 54 applied to the textile panel 28, the frangible links 44 fracture to change between the first state and the second state.

The frangible links 44 of each respective group of links 44, in which each group of frangible links 44 form a respective row of frangible links 44 extending along their respective loop centerline 52, may be manufactured from materials having different tensile strengths, such that each group of frangible links fracture in response to a different applied load. In so doing, the textile panel 28 may be segmented into zones or regions, allowing for localized control of the tension in the textile panel 28.

Referring to FIGS. 4 through 6, the tension controlling system 40 of the second embodiment of the panel assembly 20B includes a tension filament 56 that is attached to the textile panel 28, and interconnects the first member 24 and the second member 26 of the frame 22. The tension filament 56 may be attached to the textile panel 28 in a suitable manner, including but not limited to woven into the textile panel 28, bonded to the textile panel 28, etc. In the exemplary embodiment shown in the figures and described herein, the tension filament 56 includes a first portion 58 and a second portion 60. The first portion 58 extends generally parallel with the first edge 30 and the second edge 32 of the textile panel 28, and generally parallel with the first member 24 and the second member 26 of the frame 22. The second portion 60 is generally parallel with the first portion 58, and spaced away from the first portion 58. The second portion 60 also extends generally parallel with the first edge 30 and the second edge 32 of the textile panel 28, and generally parallel with the first member 24 and the second member 26 of the frame 22. In the exemplary embodiment shown and described herein, the first portion 58 and the second portion 60 of the tension filament 56 extend between the third edge 36 and the fourth edge 38 of the textile panel 28. The first portion 58 is connected to the second portion 60 by a corner portion 62. The first portion 58 is connected to the first member 24 by a first connecting portion 64. The second portion 60 is connected to the second member 26 by a second connecting portion 66.

When the tension controlling system 40 is disposed in the first state, shown in FIG. 5, the tension filament 56 has a first length measured along a centerline 68 of the tension filament 56, between the first member 24 and the second member 26. When the tension controlling system 40 is disposed in the second state, shown in FIG. 6, the tension filament 56 has a second length measured along the centerline 68 of the tension filament 56, between the first member 24 and the second member 26. The first length is different than the second length. In the exemplary embodiment shown and described herein, the second length is greater or longer than the first length. Accordingly, when the tension controlling system 40 changes between the first state and the second state, the length of the tension filament 56, measured along the centerline 68 of the tension filament 56 between the first member 24 and the second member 26, changes between the first length and the second length. Because the tension filament 56 is attached to or interwoven with the textile panel 28, changing the length of the tension filament 56 changes the tension of the textile panel 28. For example, increasing the length of the tension filament 56 relaxes the textile panel 28, whereas decreasing the length of the tension filament 56 gathers up the textile panel 28 and increases the tension in the textile panel 28.

The tension controlling system 40 further includes an actuator 70. The actuator 70 is attached to the tension filament 56, and is operable to change the length of the tension filament 56 along the centerline 68 of the tension filament 56, between the first member 24 and the second member 26. The specific type and operation of the actuator 70 will depend on the tension filament 56. For example, in one exemplary embodiment, the tension filament 56 may include a non-active material, such as a wire, fiber, yarn, etc. If the tension filament 56 is a non-active material, then the actuator 70 may be configured to retract in and/or release out the tension filament 56 to change the length of the tension filament 56 between the first member 24 and the second member 26. For example, the actuator 70 may be embodied as an electric winch or other similar device that winds the tension filament 56 around a drum.

In other embodiments, the tension filament 56 may include an active material that is operable to change shapes between a first shape and a second shape in response to a control signal. The first state of the tension controlling system 40 may be defined as the first shape of the tension filament 56, and the second state of the tension controlling system 40 may be defined as the second shape of the tension filament 56. When the tension filament 56 is controlled to exhibit the first shape, the tension filament 56 exhibits a first length along the centerline 68 of the tension filament 56, between the first member 24 and the second member 26. When the tension filament 56 is controlled to exhibit the second shape, the tension filament 56 exhibits a second length along the centerline 68 of the tension filament 56, between the first member 24 and the second member 26. If the tension filament 56 is embodied as an active material, then the actuator 70 may be configured to apply the appropriate control signal for the active material of the tension filament 56. For example, the actuator 70 may be configured to apply an electrical signal to the tension filament 56 to cause a phase change in the tension filament 56, which in turn causes the tension filament 56 to change between the first shape and the second shape.

In one exemplary embodiment, the actuator 70 may be controlled to repeatedly move the tension filament 56 between the first length and the second length in a sequential order to communicate a haptic message. For example, the panel assembly 20B may be incorporated into a seat bottom of a seat in a vehicle. The actuator 70 may be controlled by a vehicle controller to communicate a signal to an occupant of the seat. For example, the actuator 70 may be repeatedly actuated to change the tension and/or maximum sag distance in the textile panel 28 to communicate a haptic signal. As used herein, a haptic signal is a signal that is felt by the occupant. The vehicle controller may communicate the signal to alert the occupant of the seat. In other embodiments, the vehicle controller may engage the actuator 70 to move the tension filament 56, in order to change a comfort level of the seat bottom.

The textile panel 28 may be sectioned off into different regions or zones, with each zone including a respective tension filament 56 and actuator 70. In so doing, the tension of the textile panel 28 in the different zones may be controlled independently of the other zones in the textile panel. For example, the textile panel 28 may include a first zone having a first tension filament 56 that is operable to control the tension of the textile panel 28 in the first zone, and a second zone having a second tension filament 56 that is operable to control the tension of the textile panel 28 in the second zone.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

What is claimed is:

1. A panel assembly for a seat bottom, the panel assembly comprising:

a frame having a first member and a second member spaced apart from each other;

a textile panel attached to and extending between the first member and the second member;

wherein the textile panel includes a first edge and an opposing second edge extending along a central panel axis, with the textile panel attached to the first member along the first edge, and the textile panel attached to the second member along the second edge;

a tension controlling system attached to the textile panel and reconfigurable between a first state and a second state, wherein the tension controlling system is operable to tension the textile panel to provide a first tensile force when the tension controlling system is disposed in the first state, and wherein the tension controlling system is operable to tension the textile panel to provide a second tensile force when the tension controlling system is disposed in the second state, with the first tensile force different from the second tensile force; and wherein the tension controlling system includes a tension filament attached to the textile panel and interconnecting the first member and the second member of the frame.

2. The panel assembly set forth in claim 1, wherein the textile panel exhibits a first maximum sag distance relative to a reference plane when the tension controlling system is disposed in the first state, and wherein the textile panel exhibits a second maximum sag distance relative to the reference plane when the tension controlling system is disposed in the second state, with the second maximum sag distance greater than the first maximum sag distance.

3. The panel assembly set forth in claim 1, wherein the tension filament includes a first portion extending generally parallel with the first edge and the second edge.

4. The panel assembly set forth in claim 3, wherein the textile panel includes a third edge and a fourth edge spaced apart from each other and extending between the first member and the second member, with the first portion of the tension filament extending between the third edge and the fourth edge of the textile panel.

5. The panel assembly set forth in claim 4, wherein the tension filament includes a second portion extending between the third edge and the fourth edge of the textile panel.

6. The panel assembly set forth in claim 5, wherein the tension filament is an active material operable to change shapes between a first shape and a second shape, wherein the tension filament exhibits a first length along a centerline of the tension filament when disposed in the first shape, and the tension filament exhibits a second length along the centerline of the tension filament when disposed in the second shape, and wherein the first state of the tension controlling system is the first shape of the tension filament and the second state of the tension controlling system is the second shape of the tension filament.

7. The panel assembly set forth in claim 5, wherein the tension filament has a first length measured along a centerline of the tension filament, between the first member and the second member, when the tension controlling system is disposed in the first state, and wherein the tension filament has a second length measured along the centerline of the tension filament, between the first member and the second member, when the tension controlling system is disposed in the second state, with the second length greater than the first length.

8. The panel assembly set forth in claim 5, wherein the tension controlling system further includes an actuator attached to the tension filament and operable to change a length of the tension filament along a centerline of the tension filament.

9. The panel assembly set forth in claim 8, wherein the actuator is operable to retract in or release out the tension filament.

10. The panel assembly set forth in claim 8, wherein the actuator is operable to apply an electrical signal to the tension filament to cause a phase change in the tension filament.

11. The panel assembly set forth in claim 8, wherein the actuator is operable to repeatedly move the tension filament between a first length and a second length in a sequential order to communicate a haptic message.

* * * * *